US006459267B1

(12) United States Patent
Nishimoto

(10) Patent No.: US 6,459,267 B1
(45) Date of Patent: Oct. 1, 2002

(54) CYLINDER IDENTIFYING APPARATUS FOR COMBUSTION ENGINE

(75) Inventor: Kouichi Nishimoto, Kobe (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/618,720

(22) Filed: Jul. 18, 2000

(30) Foreign Application Priority Data

Apr. 17, 2000 (JP) ..... 2000-114646

(51) Int. Cl.[7] ..... F02P 17/00

(52) U.S. Cl. ..... 324/378; 324/392; 324/391; 73/116

(58) Field of Search ..... 324/78 R, 166, 324/378, 392, 76.12, 207.25, 379, 391; 701/115, 104, 105; 73/116, 117.2, 119 A; 702/100; 340/870.29; 123/65 R, 297, 382, 378, 487

(56) References Cited

U.S. PATENT DOCUMENTS 4,274,142 A * 6/1981 Furuhashi ..... 701/115
4,413,508 A * 11/1983 Yoshihisa ..... 73/116
4,566,069 A * 1/1986 Hirayama ..... 701/115
5,196,844 A * 3/1993 Tomisawa ..... 340/870.29
5,861,551 A * 1/1999 Morita ..... 73/116

FOREIGN PATENT DOCUMENTS

| | | |
|---|---|---|
| JP | 2-37154 | 2/1990 |
| JP | 4-216433 | 8/1992 |
| JP | 10-280996 | 10/1998 |

* cited by examiner

*Primary Examiner*—Michael Sherry
*Assistant Examiner*—Trung Nguyen
(74) *Attorney, Agent, or Firm*—Sughrue Mion, PLLC

(57) ABSTRACT

A cylinder identifying apparatus comprising a crank angle sensor 20 detecting a crank angle of a combustion engine 14 having a plurality of cylinders, a cylinder identifying means 31 identifying a cylinder to be controlled by an output signal from the crank angle sensor 20, a cranking judging means 34 detecting a cranking state of the combustion engine 14, and an erroneous cylinder identification preventing means 32 detecting starting of cranking of the combustion engine 14 by an output from the cranking judging means, and circumventing the cylinder identification by the cylinder identifying means 31 until a predetermined time passes after starting the cranking, whereby the cylinder to be controlled is securely identified at time of cranking, and erroneous detection, erroneous control, and detection delay are prevented.

3 Claims, 10 Drawing Sheets

SPECIFICATION OF CRANK ANGLE SENSOR SIGNAL AND CAM ANGLE SENSOR

START CRANKING
NOISE
B75
B35
B5

FIRST CRANK ANGLE SIGNAL

SECOND CRANK ANGLE SIGNAL

PREDETERMINED PERIOD OR LESS CORRESPONDING TO NUMBER OF ROTATION IN CRANKING
PREDETERMINED TIME FROM STARTING CRANKING

B75
B35
B5

FIRST CRANK ANGLE SIGNAL

SECOND CRANK ANGLE SIGNAL

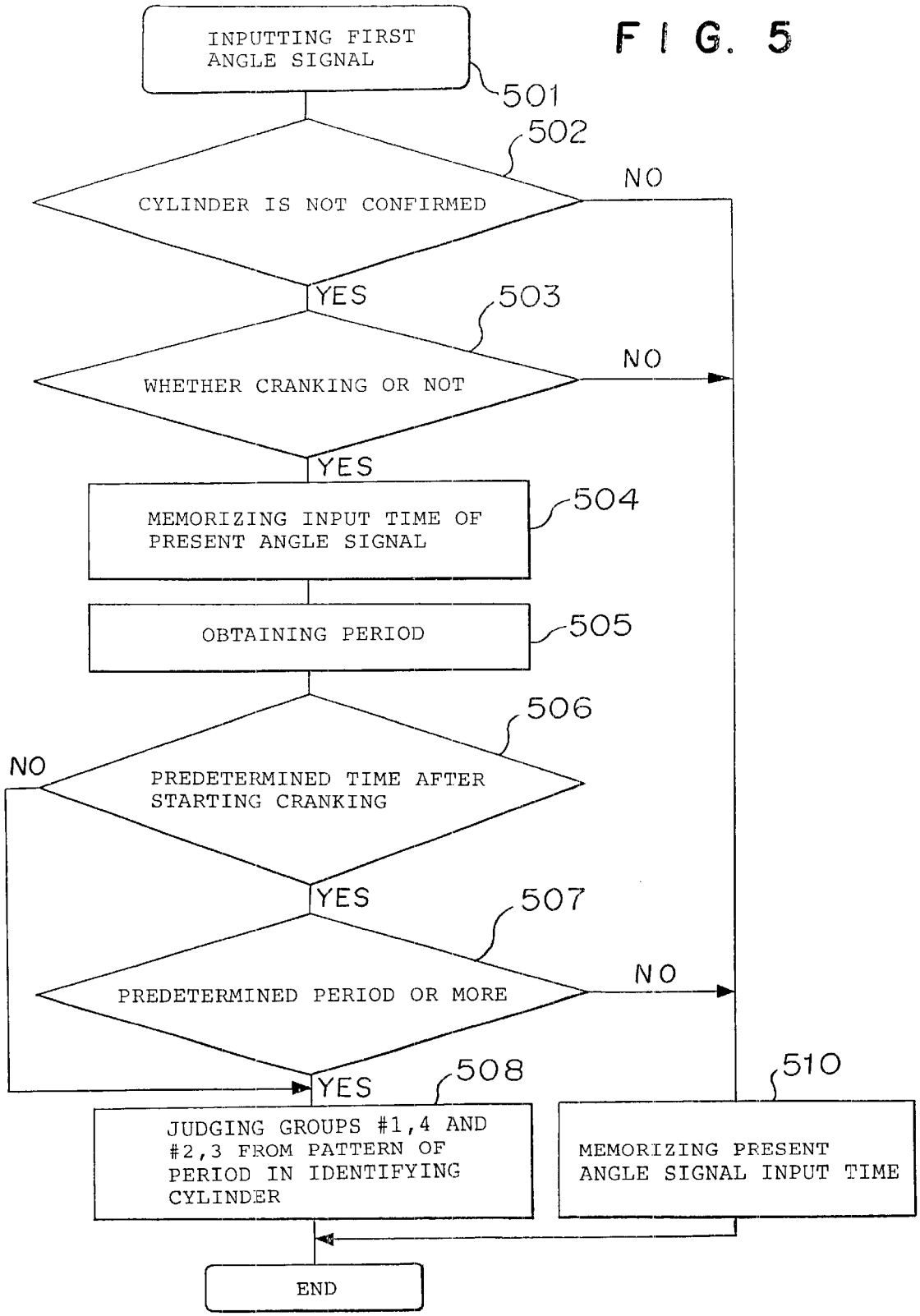
FIG. 5
INPUTTING FIRST ANGLE SIGNAL
501
502
CYLINDER IS NOT CONFIRMED
NO
YES
503
WHETHER CRANKING OR NOT
NO
YES
MEMORIZING INPUT TIME OF PRESENT ANGLE SIGNAL
504
OBTAINING PERIOD
505
506
NO
PREDETERMINED TIME AFTER STARTING CRANKING
YES
507
PREDETERMINED PERIOD OR MORE
NO
YES
508
510
JUDGING GROUPS #1,4 AND #2,3 FROM PATTERN OF PERIOD IN IDENTIFYING CYLINDER
MEMORIZING PRESENT ANGLE SIGNAL INPUT TIME
END

CYLINDER IDENTIFYING APPARATUS FOR COMBUSTION ENGINE

BACKGROUND OF THE INVENTION

1. Field of the Invention

The present invention relates to a cylinder identifying apparatus for combustion engine used to identify cylinders, to be controlled, of a multi-cylinder combustion engine.

2. Discussion of Background

In combustion engines, particularly combustion engines equipped in vehicles, an electronic controlling device, controlling injection timing and an injection quantity of fuel, ignition timing, and so on, for avoiding environmental contamination caused by exhaust gas and for improving economy such as an output characteristics with respect to fuel consumption. The electronical controlling device is further used to control various portions of the combustion engines. Therefore, the cylinders, to be controlled, are required to be controlled to perform these controls. FIGS. 8 through 14 explain an example of a structure and an operation of a conventional cylinder identifying apparatus for a combustion engine, wherein the combustion engine has four cylinders as an example.

In order to identify the cylinders to be controlled, a signal in synchronism with rotation of the combustion engine is used. Ordinarily, a crank angle signal, obtained from a rotational angle sensor located in a crankshaft or cam shaft of a combustion engine, is used. FIGS. 8 and 9 illustrate a structure of a first conventional combustion engine. Numerical reference 1 designates a crankshaft of a combustion engine (not shown) or a rotational shaft rotating in synchronism with a camshaft. Numerical reference 2 designates a rotational disk, fixed to the rotational shaft, wherein the rotational disk 2 has a plurality of windows 3 at predetermined positions, and one 3*a* of the windows is set to be asymmetric with the other windows 3. Numerical reference 4 designates a light-emitting diode (LED). Numerical reference 5 designates a photodiode receiving an output light from the LED 4 through the windows 3 and 3*a*. Numerical reference 6 designates an amplifier, amplifying an output signal from the photodiode 5. Numerical reference 7 designates an output transistor having an opened collector, wherein the output transistor works as a crank angle sensor 8.

In thus constructed crank angle sensor, when the rotational disk 2 rotates in synchronism with the crankshaft of the combustion engine, a signal illustrated in FIG. 10 is obtained in the photodiode 5 by the output light from the LED 4 through the windows 3 and 3*a*. The widths of the signals are respectively determined by lengths in a rotational direction of the windows 3 and 3*a*. These signals include a plurality of signals having signal widths of t0 corresponding to the windows 3, and a signal for identifying a specific cylinder having a signal width of t1 corresponding to the window 3*a*. Provided that the signal t1 for identifying the specific cylinder is provided for identifying a first cylinder, an order of the signals is, for example, a first cylinder, a third cylinder, a fourth cylinder, and a second cylinder, which is an order of igniting the combustion engine. For example, the signal t0 has a signal width between 75° before top dead point, hereinbelow referred to as B75, and 5° before top dead point, hereinbelow referred to as B5. For example, the signal t1 is set to have a signal width between B75 and 5° after top dead point, hereinbelow referred to as A5.

FIG. 11 is a block chart illustrating a structure of a signal processing circuit. Numerical reference 8 designates the crank angle sensor described above. Numerical reference 9 designates an interface circuit, supplying the signal outputted from the crank angle sensor 8 in FIG. 10 to a microcomputer. FIG. 12 is a flow chart illustrating an operation of the microcomputer. The microcomputer 10 identifies the cylinders by receiving the signals illustrated in FIG. 10 as follows.

In Step 101, a width t1 or t0 of a high level portion of the signal inputted from the crank angle sensor 8 and a period T of the signal from a previous rising-up and a present rising-up of the signal are measured, where, Hereinbelow, the widths t1 and t0 are inclusively referred to as t. Succeedingly, a ratio t/T between the signal width t and the period T. measured in Step 101, is operated in Step 102. In Step 103, an average threshold value $\alpha$ n satisfying t0/T>$\alpha$>t1/T is obtained from the result of t/T as follows:

$$\alpha n=(1-k)\alpha n-1+k(t/T)n,$$

where reference k denotes a constant.

In Step 104, t/T obtained in the Step 102 and $\alpha$n obtained in the Step 103 are compared. When t/T−$\alpha$n>0, the present signal width is determined to be t1 to know the specific cylinder. Thereafter, in Step 105, a cylinder identifying flag is set, when t/T−$\alpha$n<0, it is judged that the present signal is t0, indicating that the signal is not for the specific cylinder, the cylinder identifying flag is not set. In FIG. 10, the signal identifying flag is set in a control of the first cylinder, and thereafter the third cylinder, the fourth cylinder, and the second cylinder are sequentially controlled in the order of igniting the combustion engine with respect to succeeding signals.

FIG. 13 illustrates a schematic structure of a second conventional cylinder identifying apparatus. In the second conventional apparatus, a crank angle sensor 11 includes a rotating magnetic material 12 having a plurality of protruding teeth 12*a* around an outer periphery thereof, the rotating magnetic material 12 is attached to a cam shaft, rotating in synchronism with a crankshaft of a combustion engine, and a signal generator 13, arranged with the teeth 12*a* with a gap, for generating a signal depending on a change of a magnetic resistance of the gap, wherein the signal from the crank angle sensor 11 is supplied to a microcomputer 10 through an interface circuit 9.

The teeth 12*a* formed in the rotating magnetic material 12 are arranged with, for example, an interval of 10° of a rotational angle of the crankshaft. As illustrated in FIG. 13, in predetermined positions, the teeth 12*a* are thinned out such that an interval between adjacent teeth 12*a* is 30° in a portion 12*b*, an interval between adjacent teeth 12*a* is 30° in a portion 12*c*, and the portions 12*b* and 12*c* are continuous to lack a signal pulse waveform, generated by the signal generator 13 at these portions.

The signal waveform is illustrated in FIGS. 14*a* and 14*b*, wherein a case that a first cylinder and a fourth cylinder are simultaneously ignited, and a second cylinder and a third cylinder are simultaneously ignited is illustrated as an example. FIG. 14*a* shows a signal waveform inputted in the microcomputer 10 from the crank angle sensor 11 through the interface circuit 9, wherein signals are pulses having an interval of 10°. In portions corresponding to the first and fourth cylinders, there is the thinned-out portion of 30° just before the signal at B35, and two continuous thinned-out portions exist just before and just after the signal B35 at the second and third cylinders.

The microcomputer 10 operates each signal interval, and judges which signals belong to a group of the first and fourth cylinders or a group of the second and third cylinders depending on a ratio between a previous signal interval and a present signal interval, counts these signals to detect B75 signal and B5, starts processing of an ignition timing and a fuel injection timing, as illustrated in FIG. 14*b*, and resets counting-up after counting signals corresponding to two revolutions of the crankshaft in order to prepare for processing of coming two revolutions.

However, in the conventional cylinder identifying apparatuses, when a noise signal is superposed on a nomal signal by a noise from a power source, determination of the cylinders by a signal width and a signal interval becomes erroneous, and a fuel is supplied to wrong cylinders and wrong cylinders are ignited, whereby troubles such as backfire may occur. Therefore, in the conventional apparatus, a means for preventing an erroneous operation by circumventing the cylinder identifying operation is effected when an impossible signal in operating the combustion engine, for example, a case that signals having a signal width and a signal interval, corresponding to 18,000 rpm are inputted in the microcomputer 10. However, there is a case that a noise and so on, caused along with a drop of a power source voltage at time of cranking of the combustion engine superpose on the normal signal. In this case, it is impossible to circumvent the signal identifying operation in the conventional techniques because a waveform of the noise does not look like a high revolution. Because of insufficient identification of the cylinders, many troubles occur just after starting the cranking.

SUMMARY OF THE INVENTION

It is an object of the present invention to solve the above problems inherent in the conventional technique and to provide a cylinder identifying apparatus for combustion engine, which can securely identify cylinders at time of cranking the combustion engine and does not erroneously detect, erroneously control, or caused a delay in detecting the cylinders.

According to a first aspect of the present invention, there is provided a cylinder identifying apparatus for a combustion engine comprising: a crank angle sensor, detecting a crank angle of the combustion engine having a plurality of cylinders; a cylinder identifying means, identifying a cylinder to be controlled based on an output signal from the crank angle sensor; a cranking judging means, detecting a cranking state of the combustion engine; and an erroneous cylinder identification preventing means.

According to a second aspect of the present invention, there is provided a cylinder identifying apparatus for a combustion engine comprising: a crank angle sensor, detecting a crank angle of a combustion engine having a plurality of cylinders; a cylinder identifying means, identifying a cylinder to be controlled by an output signal from the crank angle sensor; a cranking judging means, detecting a cranking state of the combustion engine; and an erroneous cylinder identification preventing means, detecting starting of cranking of the combustion engine from an output from the cranking determining means, and circumventing identification of the cylinder by the cylinder identifying means when it is detected that a signal interval of the output signal from the crank angle sensor is a predetermined value or less in a predetermined time after the starting of the cranking.

According to a third aspect of the present invention, there is provided a cylinder identifying apparatus comprising: a first crank angle sensor, detecting a crank angle of a combustion engine having a plurality of cylinders and outputting a crank angle signal; a second crank angle sensor, detecting the crank angle of the combustion engine and outputting another crank angle signal having a mode different from the output signal from the first crank angle sensor; a cylinder identifying means, identifying a cylinder to be controlled by the output signals from the first crank angle sensor and the second crank angle sensor; a cranking judging means, detecting a state of cranking of the combustion engine; and an erroneous cylinder identification preventing means, detecting the cranking state of the combustion engine from an output from the cranking judging means and circumventing one of two events of cylinder identification based on the crank angle signals from the first and second crank angle sensors before the one of the two events of the cylinder identification is established.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein:

FIG. 5 is a flow chart explaining an operation of the cylinder identifying apparatus for the combustion engine according to Embodiment 1 of the present invention;

DETAILED DESCRIPTION OF THE PREFERRED EMBODIMENTS

A detailed explanation will be given of preferred embodiments of the present invention in reference to FIG. 1 through 7 as follows, wherein the same numerical references are used for the same or similar portions and descriptions of these portions is omitted.

EMBODIMENT 1

Figure 1:
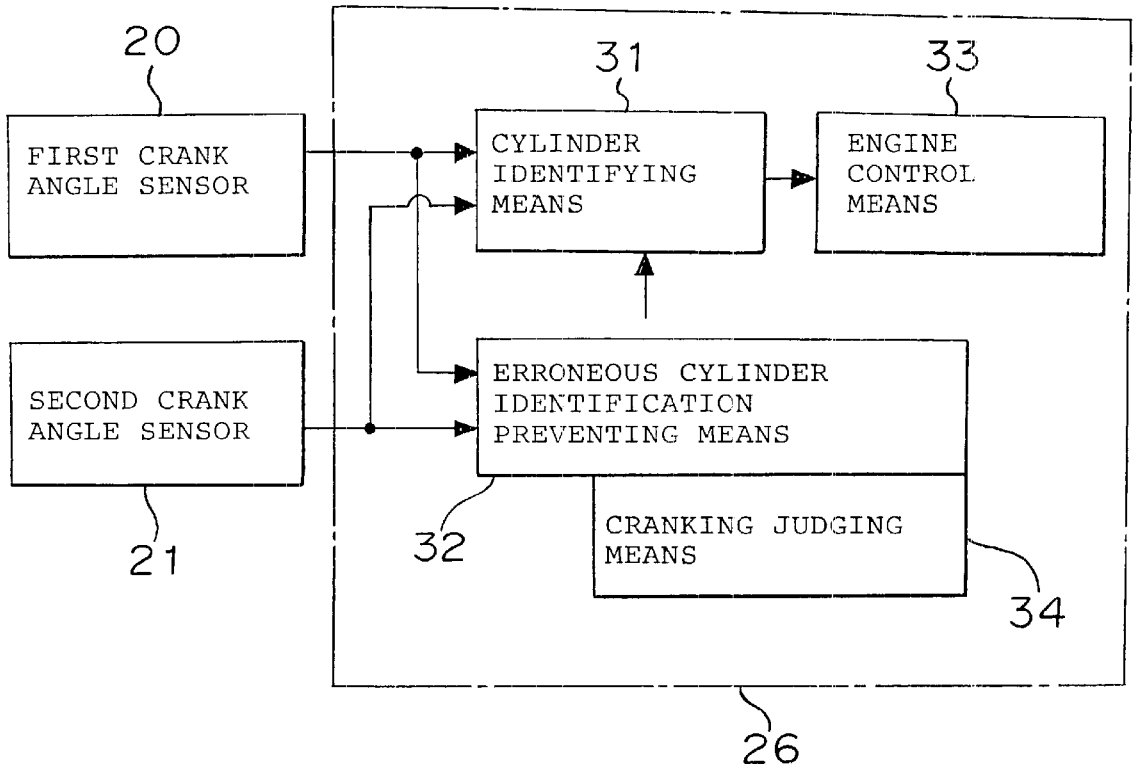
FIG. 1 is a block chart of a cylinder identifying apparatus for a combustion engine according to Embodiment 1 of the present invention.
Figure 2:
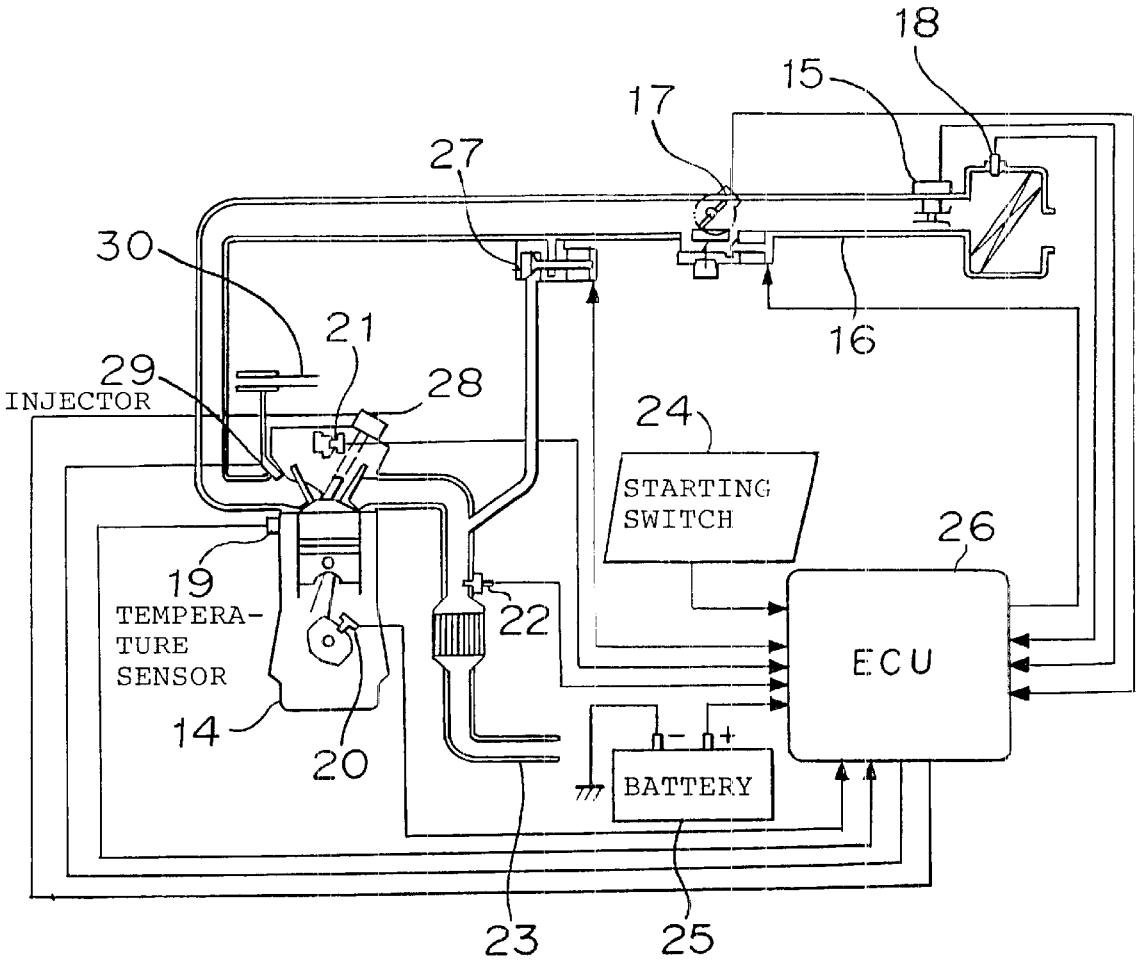
FIG. 2 illustrates a system of the combustion engine for describing Embodiment 1 of the present invention.
Figure 6:
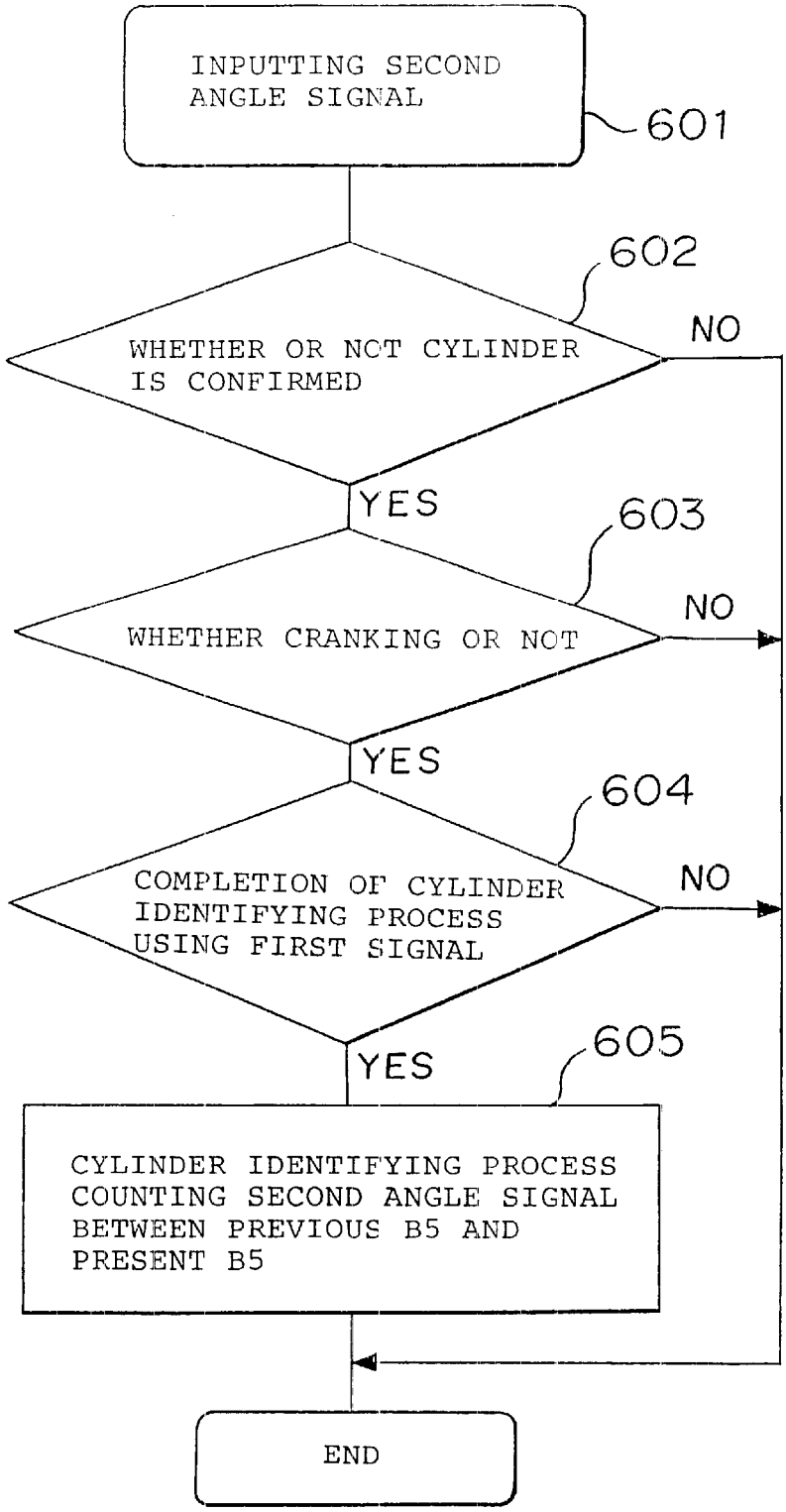
FIG. 6 is a flow chart explaining an operation of the cylinder identifying apparatus for the combustion engine according to Embodiment 1 of the present invention.
Figure 7:
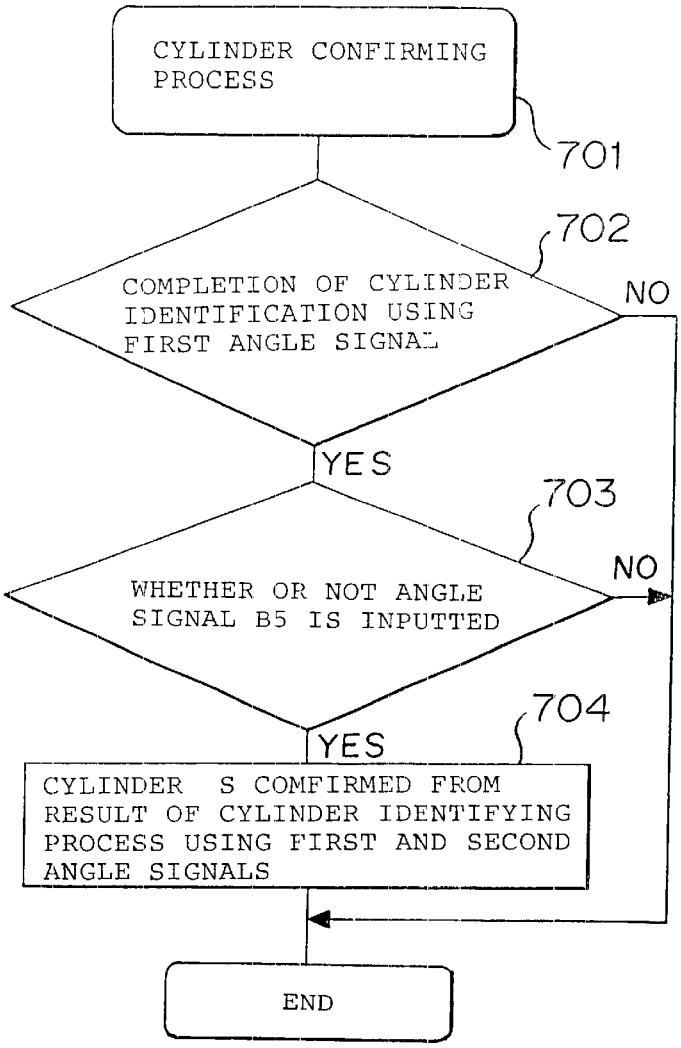
FIG. 7 is a flow chart explaining an operation of the cylinder identifying apparatus for the combustion engine according to Embodiment 1 of the present invention.
Figure 8:
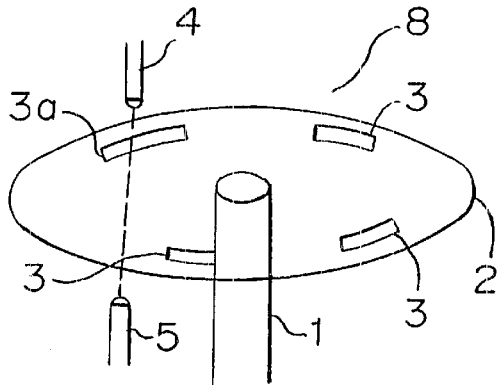
FIG. 8 illustrates a structure of a crank angle sensor of a conventional cylinder identifying apparatus of combustion engine.
Figure 9:
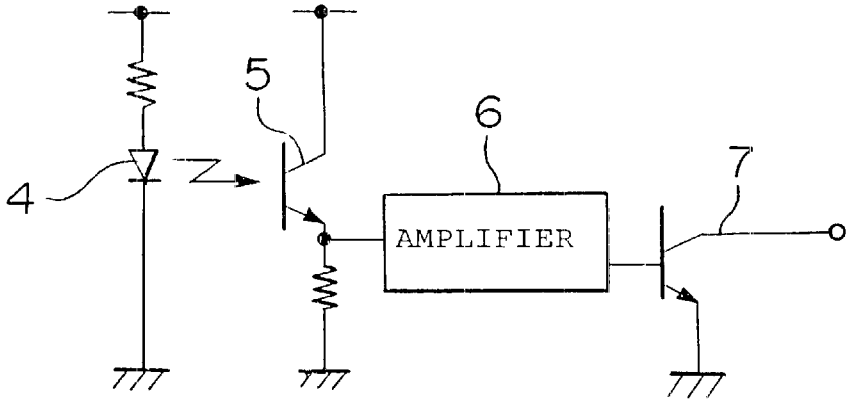
FIG. 9 a circuit diagram of the crank angle sensor of the conventional cylinder identifying apparatus of combustion engine.
Figure 10:
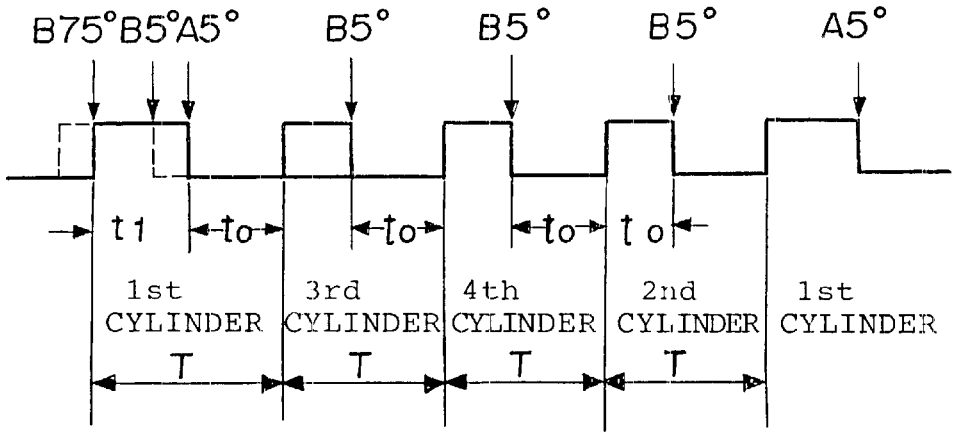
FIG. 10 illustrates an operation of the conventional cylinder identifying apparatus of combustion engine.
Figure 11:
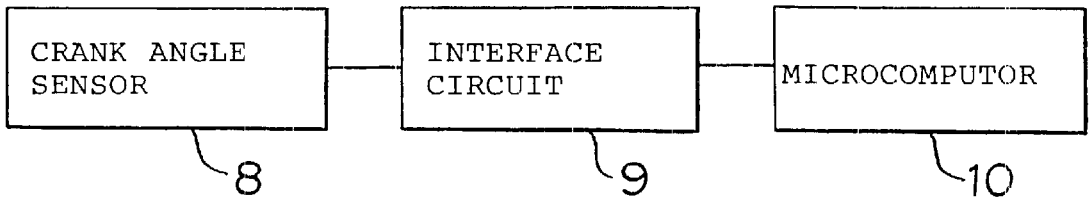
FIG. 11 a block chart illustrating the conventional cylinder identifying apparatus of combustion engine.
Figure 12:
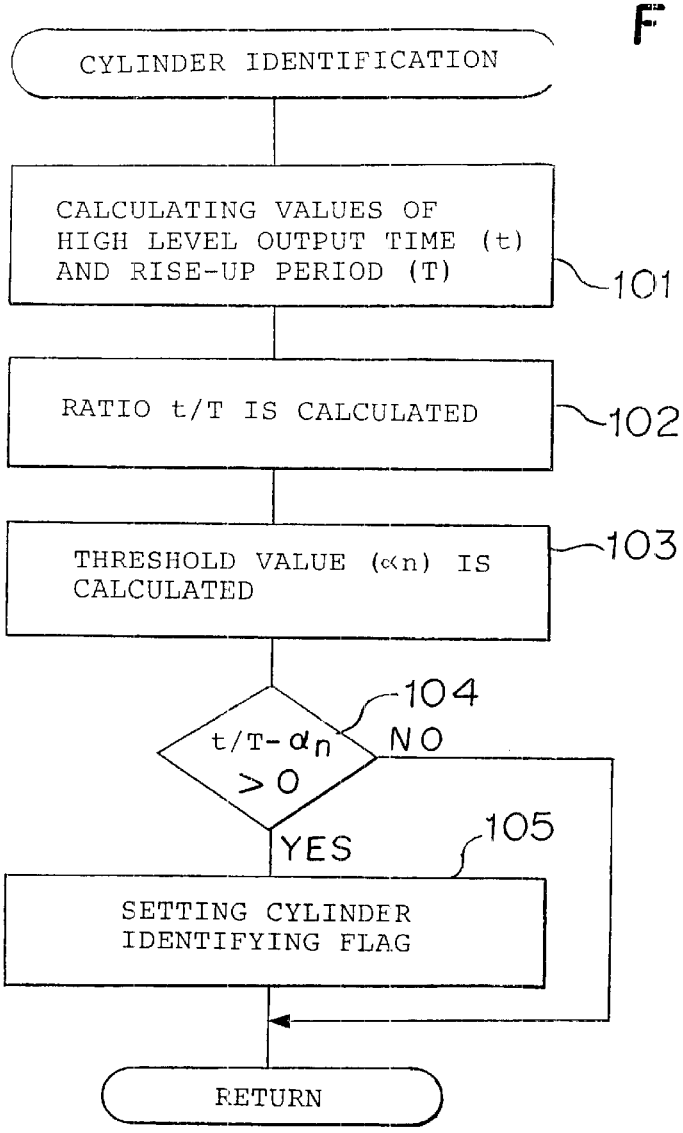
FIG. 12 illustrates an operation of the conventional cylinder identifying apparatus of combustion engine.
Figure 13:
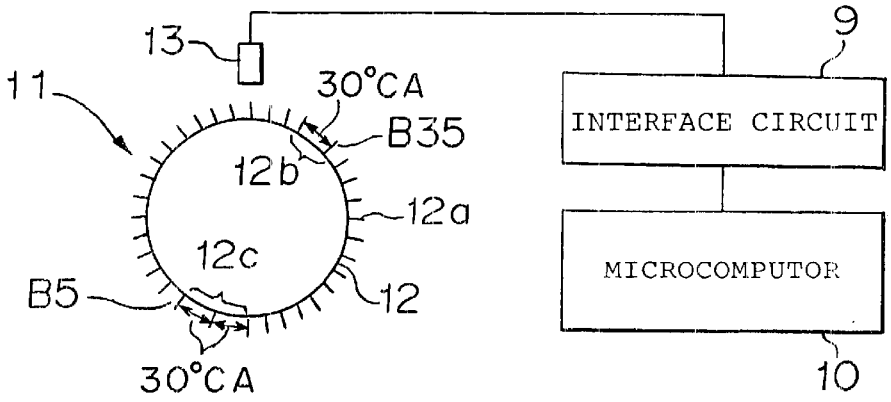
FIG. 13 illustrates a structure of another conventional cylinder identifying apparatus of combustion engine.
Figure 14A:
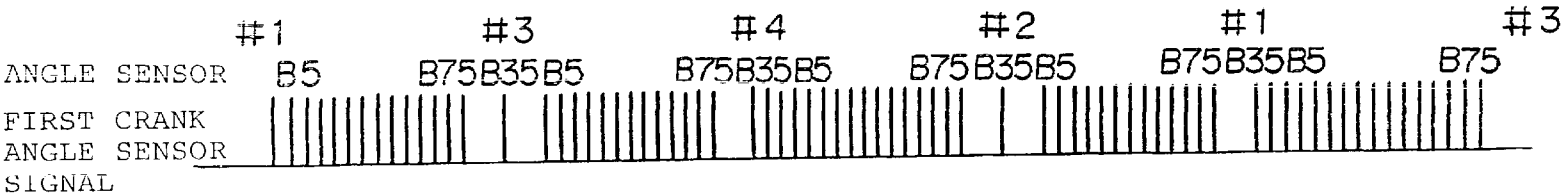
FIG. 14*a* illustrates an operation of the conventional cylinder identifying apparatus of combustion engine.
Figure 14B:
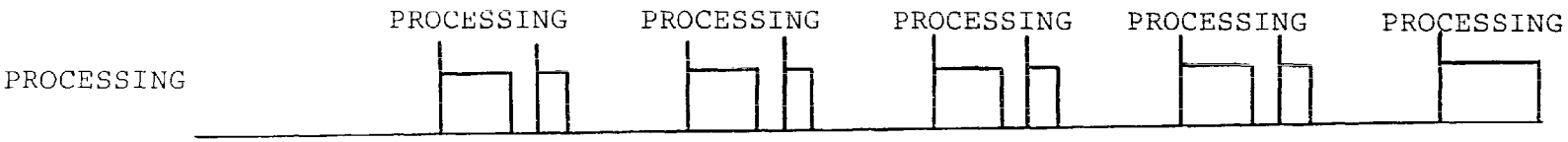
FIG. 14*b* illustrates the operation of the conventional cylinder identifying apparatus of combustion engine.

FIGS. 1 through 7 illustrate a structure and an operation of a cylinder identifying apparatus for a combustion engine according to Embodiment 1 of the present invention. FIG. 1 is a block chart illustrating a structure of the cylinder identifying apparatus. FIG. 2 is a system chart of control equipment installed in the combustion engine. FIGS. 3*a* through 4*f* explain the operation of the cylinder identifying apparatus. FIGS. 5 through 7 are flow charts illustrating the operation of the cylinder identifying apparatus.

In the system chart illustrated in FIG. 2, numerical reference 14 designates the combustion engine; numerical reference 15 designates an air flow sensor located in an intake port 16 of the combustion engine 14; numerical reference 17 designates a throttle sensor detecting an opening degree of a throttle valve located in the intake port 16; numerical reference 18 designates an intake air sensor located in an air cleaner, positioned in a tip portion of the intake port 16; numerical reference 19 designates a coolant temperature sensor located in the combustion engine 14; numerical reference 20 designates a first crank angle sensor measuring a rotational angle of a crankshaft of the combustion engine 14; numerical reference 21 designates a second crank angle sensor detecting the rotational angle of the crankshaft by detecting a rotational angle of a camshaft, rotating in synchronism with the crankshaft of the combustion engine 14; numerical reference 22 designates an oxygen sensor, located in an exhaust port 23 of the combustion engine 14 for detecting an oxygen concentration of an exhaust gas; numerical reference 24 designates a starting switch starting the combustion engine 14; numerical reference 25 designates a battery as a power source; and numerical reference 26 designates a control unit.

Numerical reference 27 designates an EGR valve circulating a part of the exhaust gas to return the intake port 16; numerical reference 28 designates an ignition coil applying an ignition voltage to an ignition plug (not shown); numerical reference 29 designates a fuel injection valve injecting a fuel accumulated in a delivery pipe 30 to the intake port 16. The EGR valve 27, the ignition coil 28, and the fuel injection valve 29 are operated by a command from the control unit 26. The control unit 26 receives signals from the various sensors and signals obtained by operating switches, operates running conditions of the combustion engine 14, and controls the combustion engine 14 by a control program, installed in the control unit 26 for controlling injection, ignition timing, and so on of the fuel for the combustion engine.

As illustrated in the block chart of FIG. 1, outputs from the first and second crank angle sensors 20 and 21 are inputted in a cylinder identifying means 31 and an erroneous cylinder identification preventing means 32, respectively of the control unit 26. A result of identifying cylinders, obtained in the cylinder identifying means 31, is inputted in an engine control means 33, controlling the combustion engine 14, wherein ignition and fuel injection are controlled. The erroneous cylinder identification preventing means 32 has a cranking judging means 34 detecting a state of cranking of the combustion engine 14, wherein the cranking judging means 34 circumvents an output from the cylinder identifying means in a predetermined time after starting the cranking or in case that a signal interval within the predetermined time after the cranking is less than a predetermined value. The cylinder identifying means 31 identifies the cylinders by a known means using operations described in the above-mentioned conventional techniques.

Figure 3A:
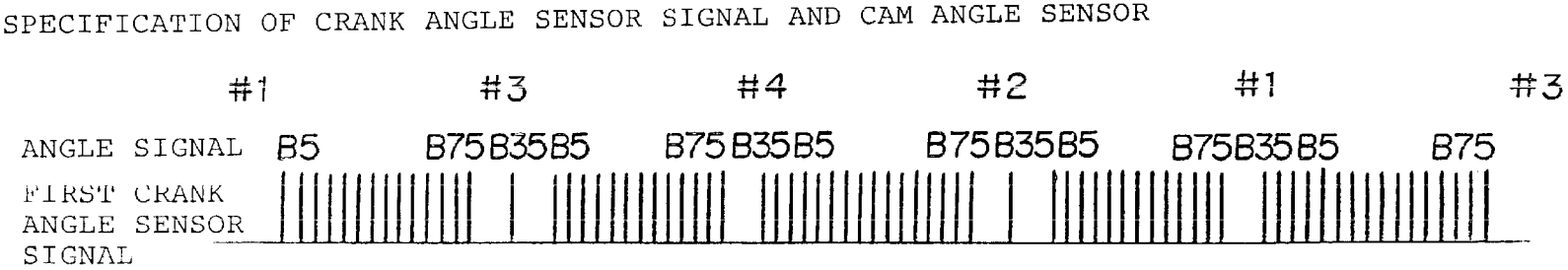
FIG. 3*a* illustrates an operation of the cylinder identifying apparatus for the combustion engine according to Embodiment 1 of the present invention.

The operation of the cylinder identifying apparatus for the combustion engine according to Embodiment 1 will be described in reference of FIGS. 3*a* through 7. The first crank angle sensor 20 outputs signals having interval of 10° as illustrated in FIG. 3*a*, in a manner similar to, for example, that in the above-mentioned second conventional technique. The signals have a thinned-out portion having an interval of 30° ahead of a signal B35 at portions corresponding to a first cylinder and a fourth cylinder, and thinned-out portions having intervals of 30° just ahead of and just behind signals B35 at portions corresponding to a second cylinder and a third cylinder. An output signal from the second crank angle sensor 21 is effected at a position corresponding to B25 of the first crank angle sensor 20 in portions corresponding to the first and second cylinders, and output signals at positions corresponding to B55 and B25 of the first crank angle sensor 20 in the portions corresponding to the third and fourth cylinders.

Figures 4A, 4B, 4C, 4D, 4E, 4F:
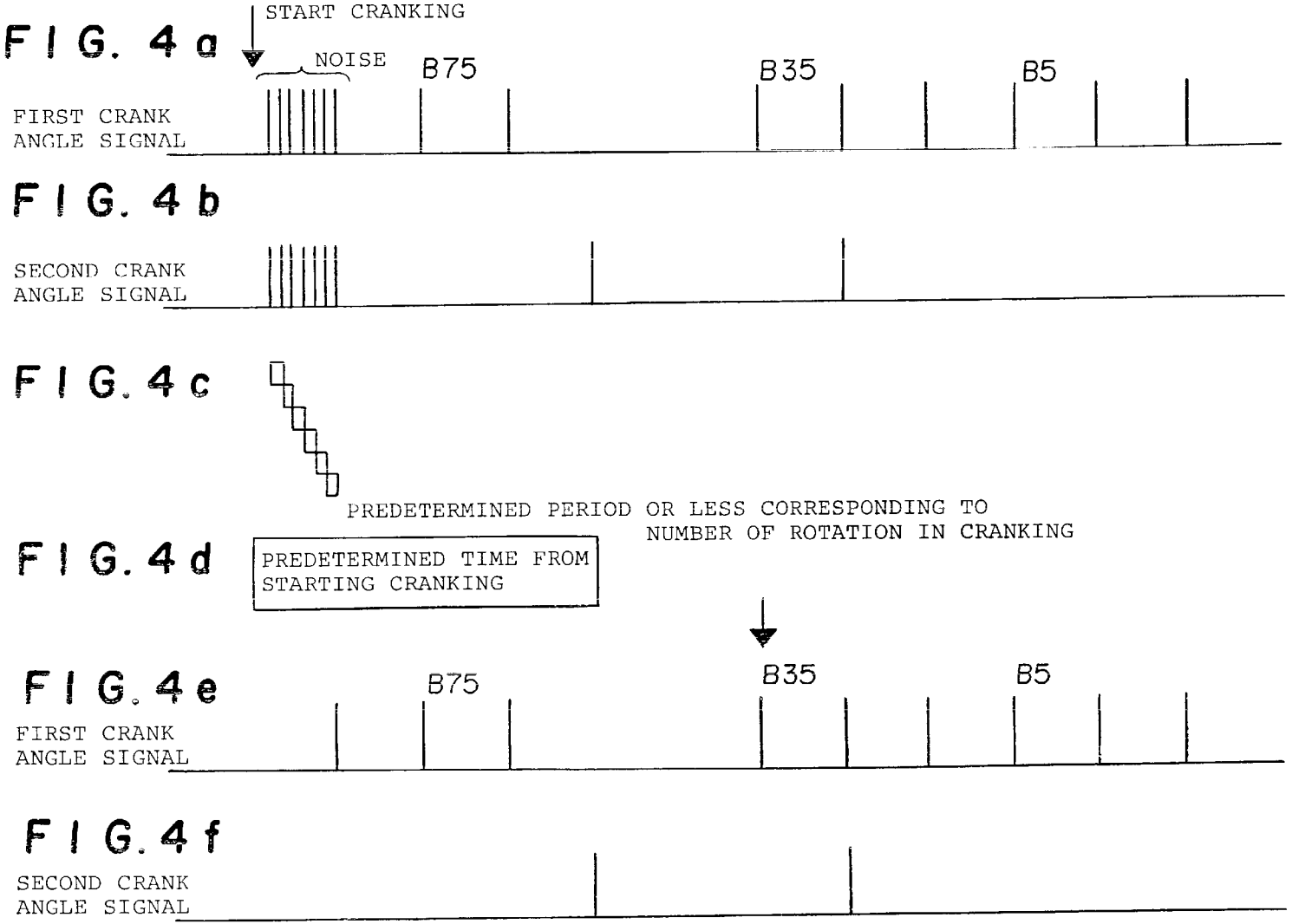
FIG. 4*a* illustrates an operation of the cylinder identifying apparatus for the combustion engine according to Embodiment 1 of the present invention.
FIG. 4*b* illustrates the operation of the cylinder identifying apparatus for the combustion engine according to Embodiment 1 of the present invention.
FIG. 4*c* illustrates the operation of the cylinder identifying apparatus for the combustion engine according to Embodiment 1 of the present invention.
FIG. 4*d* illustrates the operation of the cylinder identifying apparatus for the combustion engine according to Embodiment 1 of the present invention.
FIG. 4*e* illustrates the operation of the cylinder identifying apparatus for the combustion engine according to Embodiment 1 of the present invention.
FIG. 4*f* illustrates the operation of the cylinder identifying apparatus for the combustion engine according to Embodiment 1 of the present invention.

FIGS. 4*a* and 4*b* are charts, in which time axes of the signals are enlarged. When the starting switch 24 of the combustion engine is turned on to start the cranking, the output signals from the first crank angle sensor 20 and the second crank angle sensor 21 are superposed by noises, caused by a voltage variation of the battery 25 and so on, as illustrated in FIGS. 4*a* and 4*b*. The noises are conspicuous in a state that a rotational speed just after starting the combustion engine is not sufficiently increased because a current consumption of a starting motor is large and a variation of a power source voltage is large. In comparison with the signals from the crank angle sensors at time of cranking, the noises have relatively short intervals of signal pulses. These noises disturb arrangements of previously set signal periods of the first and second crank angle sensors 20 and 21, whereby erroneous ignition and erroneous injection may be caused.

In the cylinder identifying apparatus for the combustion engine according to Embodiment 1, since the cranking judging means 34 detecting the cranking of the combustion engine 14 is built in the erroneous cylinder identification preventing means 32, and the output from the cylinder identifying means 31 is circumvented within the predetermined time after starting the cranking, an erroneous operation can be securely prevented even though the above-mentioned noises occur. Further, since the erroneous cylinder identification preventing means 32 is set to circumvent the output from the cylinder identifying means 31 when the signals are inputted with the intervals of the previously set predetermined values or less in the predetermined time after starting the cranking, it is possible to quickly determine the cylinder even within the predetermined time after the noises vanish and start the combustion engine.

Therefore, the control unit 26 including the erroneous cylinder identification preventing means 32 is operated as illustrated in the flow charts of FIGS. 5 through 7 in receipt of the signals from the crank angle sensors 20 and 21. In Step 501 in FIG. 5, when the signal illustrated in FIGS. 3*a* and 4*a* is inputted from the first crank angle sensor 20, it is judged whether or not the cylinder identification is confirmed in Step 502. If the cylinder identification is not confirmed, it is judged whether or not cranking is performed in Step 503. If being in a way of cranking, an input time of the signal, inputted in Step 501, is memorized in Step 504. In Step 505, a previous signal input time and a present signal input time are processed to obtain a signal interval. In Step 506, it is judged whether or not the predetermined time lapses after starting the cranking.

In Step 506, if the predetermined time does not lapse, Step 507 is selected. In Step 507, it is judged whether or not the signal interval obtained in Step 505 is a predetermined value or more. If the signal interval is the predetermined value or more, Step 508 is selected to precede the cylinder identification. When the cylinder identification is confirmed in Step 502, or the cranking is not judged in Step 503, Step 510 is selected to memorize the signal input time. When the lapse of the predetermined time is judged in Step 506, Step 507 is not selected, and a process of identifying the cylinder is conducted. Further, when the signal interval is less than the predetermined value in Step 507, an existence of noise is judged, wherein Step 510 is selected to memorize the signal input time.

As described, in Steps 505 through 507, when a noise exists in the signal pulses as illustrated in FIG. 4*a* within the predetermined time after starting the cranking as illustrated in FIG. 4*d*, the noise is confirmed because the signal pulses have short intervals. Then the noise is removed from a signal identifying process as illustrated in FIG. 4*c*, whereby only normal signals illustrated FIGS. 4*e* and 4*f* are outputted to enable cylinder identification. Further, it is judged whether the cylinder belongs to a group of first and fourth cylinders or a group of second and third cylinders from variation of the signals interval caused by a thinned-out portion of the signal pulses between the signal B75 and the signal B5 in FIG. 3*a*.

As illustrated in FIG. 6, the signal of the second crank angle sensor 21 is inputted in Step 601. In Step 602, it is judged whether or not the cylinder identification is confirmed by the signal from the second crank angle sensor 21. If the cylinder identification is not confirmed, Step 603 is selected to judge whether or not the combustion engine is cranking. If the combustion engine is cranking, Step 604 is selected to judge whether or not the cylinder identification is confirmed by the signal from the first crank angle sensor 20 as illustrated in FIG. 5. If the cylinder identification is confirmed, Step 605 is selected to count the number of the signals from the second crank angle sensor 21 between the previous signal B5 and the present signal B5 from the first crank angle sensor 20. Step 605 is not processed when the cylinder identification is confirmed by the signal from the second crank angle sensor 21 in Step 602, the combustion engine is not cranking in Step 603, or when the cylinder identification is not confirmed by the output signal from the first crank angle sensor 20 in Step 604.

In the next, a result of the confirmation of the cylinder identifying process in Step 508 in a routine, illustrated in FIG. 5, is transmitted to Step 701 in a flow chart illustrated in FIG. 7. In Step 702, it is judged whether or not the cylinder identification is confirmed by the signal from the first crank angle sensor 20. When. the confirmation of the cylinder identification is judged, Step 703 is processed to select the signal B5 from the first crank angle sensor 20. Thereafter, Step 704 is processed. In Step 704, these are judged whether the cylinder is in the group of the first and fourth cylinders or the group of the second and third cylinders as the above-described judgment in Step 508, and which cylinder is subjected to the present process based on the number of the signals from the second crank angle sensor 20 between the previous and present signals B5 as in Step 605 of FIG. 6. When the cylinder identification is not confirmed in Step 702, Step 704 is not processed.

Figure 3B:
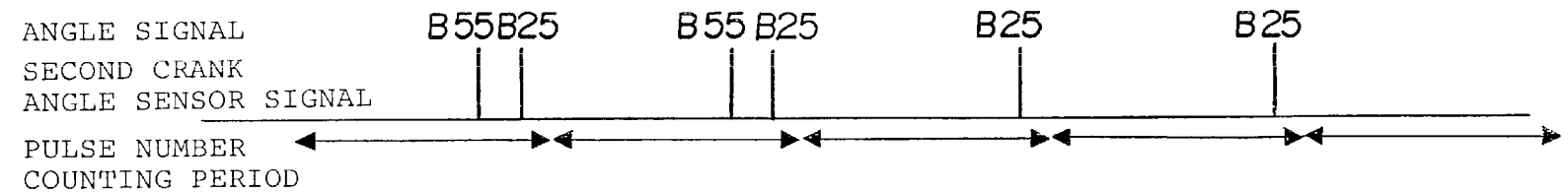
FIG. 3*b* illustrates the operation of the cylinder identifying apparatus for the combustion engine according to Embodiment 1 of the present invention.

The process in Step 704 will be described in reference of FIG. 3. The cylinder can be identified by the signal from the first crank angle sensor 20 illustrated in FIG. 3*a* with respect to the group of the first and fourth cylinders having same signal patterns, and the group of the second and third cylinders having same signal patterns. Signal patterns of the first and fourth cylinders of the signals from the second crank angle sensor 21 illustrated in FIG. 3*b* are different, and signal patterns of the second and third cylinders of the signals from the second crank angle sensor 21 illustrated in FIG. 3*b* are also different, it is possible to judge the present signal corresponds to which cylinder based on the signals from the first and second crank angle sensors 20 and 21.

The first advantage of the cylinder identifying apparatus for the combustion engine according to the present invention is that erroneous operations just after starting the combustion engine can be securely prevented, and the cylinder can be identified immediately after the noise signals vanish.

The second advantage of the cylinder identifying apparatus for the combustion engine according to the present invention is that the specific cylinder can be securely identified.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2000-114646 filed on Apr. 17, 2000 including specification, claims, drawings and summary are incorporated herein by reference in its entirety.

What is claimed is:

1. A cylinder identifying apparatus for a combustion engine comprising:

a crank angle sensor, detecting a crank angle of the combustion engine having a plurality of cylinders;

a cylinder identifying means, identifying a cylinder to be controlled based on an output signal from the crank angle sensor;

a cranking judging means, detecting a cranking state of the combustion engine; and an erroneous cylinder identification preventing means.

2. A cylinder identifying apparatus for a combustion engine comprising:

a crank angle sensor, detecting a crank angle of a combustion engine having a plurality of cylinders;

a cylinder identifying means, identifying a cylinder to be controlled by an output signal from the crank angle sensor;

a cranking judging means, detecting a cranking state of the combustion engine; and an erroneous cylinder identification preventing means, detecting starting of cranking of the combustion engine from an output from the cranking determining means, and circumventing identification of the cylinder by the cylinder identifying means when it is detected that a signal interval of the output signal from the crank angle sensor is a predetermined value or less in a predetermined time after the starting of the cranking.

3. A cylinder identifying apparatus comprising:

a first crank angle sensor, detecting a crank angle of a combustion engine having a plurality of cylinders and outputting a crank angle signal;

a second crank angle sensor detecting the crank angle of the combustion engine and outputting another crank angle signal having a mode different from the output signal from the first crank angle sensor;

a cylinder identifying means, identifying a cylinder to be controlled by the output signals from the first crank angle sensor and the second crank angle sensor;

a cranking judging means, detecting a state of cranking of the combustion engine; and an erroneous cylinder identification preventing means, detecting the cranking state of the combustion engine from an output from the cranking judging means and circumventing one of two events of cylinder identification based on the crank angle signals from the first and second crank angle sensors before the one of the two events of the cylinder identification is established.

* * * * *